US008869325B2

(12) United States Patent
Ng et al.

(10) Patent No.: US 8,869,325 B2
(45) Date of Patent: Oct. 28, 2014

(54) CONVERTIBLE BLANKET FOR CONVERTING TO TOY

(71) Applicant: FFD Designs (Canada) Inc., Richmond Hill (CA)

(72) Inventors: Cheryl Ng, Richmond Hill (CA); Evelyn Yu, Richmond Hill (CA)

(73) Assignee: FFD Designs (Canada) Inc., Richmond Hill, Ontario (CA)

( * ) Notice: Subject to any disclaimer, the term of this patent is extended or adjusted under 35 U.S.C. 154(b) by 0 days.

(21) Appl. No.: 13/683,498

(22) Filed: Nov. 21, 2012

(65) Prior Publication Data

US 2014/0013508 A1 Jan. 16, 2014

(30) Foreign Application Priority Data

Jul. 12, 2012 (CA) ..... 2783191

(51) Int. Cl.
*A47G 9/02* (2006.01)

(52) U.S. Cl.
CPC ..... *A47G 9/0223* (2013.01); *Y10S 5/907* (2013.01)
USPC ..... 5/486; 5/655; 5/636; 5/907; 5/485; 5/502

(58) Field of Classification Search
USPC ..... 5/482, 485, 907, 655, 502, 413 R
See application file for complete search history.

(56) References Cited

U.S. PATENT DOCUMENTS

| | | | |
|---|---|---|---|
| 1,575,263 | A | 3/1926 | Guglielmi |
| 4,739,529 | A | 4/1988 | Mills |
| 4,754,512 | A | 7/1988 | Chao-Yang |
| D305,844 | S | 2/1990 | Chang |
| 5,084,930 | A | 2/1992 | Danova |
| 5,093,947 | A | 3/1992 | Henegar et al. |
| 5,638,561 | A | 6/1997 | Sperry et al. |
| 6,421,852 | B1 | 7/2002 | Shao |
| 6,427,267 | B1 | 8/2002 | Turner |
| 8,550,866 | B2 | 10/2013 | Wadhwani |
| 2004/0199998 | A1 | 10/2004 | Shinner |
| 2011/0070802 | A1 | 3/2011 | Li et al. |
| 2012/0005831 | A1 | 1/2012 | Waters et al. |

FOREIGN PATENT DOCUMENTS

GB 2277024 10/1994

OTHER PUBLICATIONS

Google, http://www.google.com/products/catalog?hl=en&cp=10&gs_id=t&xhr=t&g=animal+blankets&biw=1280&bih=750&bav=on.2,or.r_gc.r_pw.r_qf.,cf.osb&wrapid=tlif133649206991110&um=1&ie=UTF-8&tbm=shop&cid=13287633617522200945&sa=X&ei=JUCpT-WgOorl0QGwpcjUDw&sqi=2&ved=0COABEPMCMAQ, Retrieved May 16, 2012.

Jay at Pay, Intl., 2013, https://www.cuddleuppets.com/?MID=1442674&gclid=CLKv3cGF8a8CFQjf4Aodp1N6VQ, Retrieved May 16, 2012.

CIPO, CA Office Action relating to Application No. 2,783,191, dated Dec. 4, 2013.

*Primary Examiner* — Brittany Wilson
(74) *Attorney, Agent, or Firm* — Rowand LLP

(57) ABSTRACT

A convertible blanket, method of converting a convertible blanket and kit including a convertible blanket are described. A convertible blanket includes a fabric blanket portion having a top end, a bottom end and sides. The convertible blanket also includes one or more front-of-creature features defining a front of the creature. The front-of-creature features are disposed on a surface of the fabric blanket portion to offset the front of the creature from each of the sides of the fabric blanket portion. The convertible blanket also includes one or more fasteners attached to the fabric blanket portion. The one or more fasteners are configured to releasably hold the convertible blanket in a position where the toy is formed.

17 Claims, 7 Drawing Sheets

CONVERTIBLE BLANKET FOR CONVERTING TO TOY

FIELD

The present application relates to blankets and, more particularly, to a convertible blanket that is convertible between a blanket and a toy resembling a creature.

BACKGROUND

Children often utilize a variety of items in order to ensure their comfort and to keep them entertained and amused. Many adults who have travelled with children understand how difficult it may be to travel with such creature comforts. For example, children often require blankets, towels, clothes or bedding to ensure their safety and comfort and also benefit from toys, such as stuffed animals, which entertain the children and keep them amused.

Some of these items function both to amuse children and to provide a more utilitarian function, such as acting as a blanket for the child.

Such items tend to function poorly for at least one of their intended purposes. For example, blankets which convert to a toy often function poorly as a blanket or poorly as a toy.

BRIEF DESCRIPTION OF THE DRAWINGS

Reference will now be made, by way of example, to the accompanying drawings which show example embodiments of the present application, and in which.

Like reference numerals are used in the drawings to denote like elements and features.

DETAILED DESCRIPTION

Figure 1:
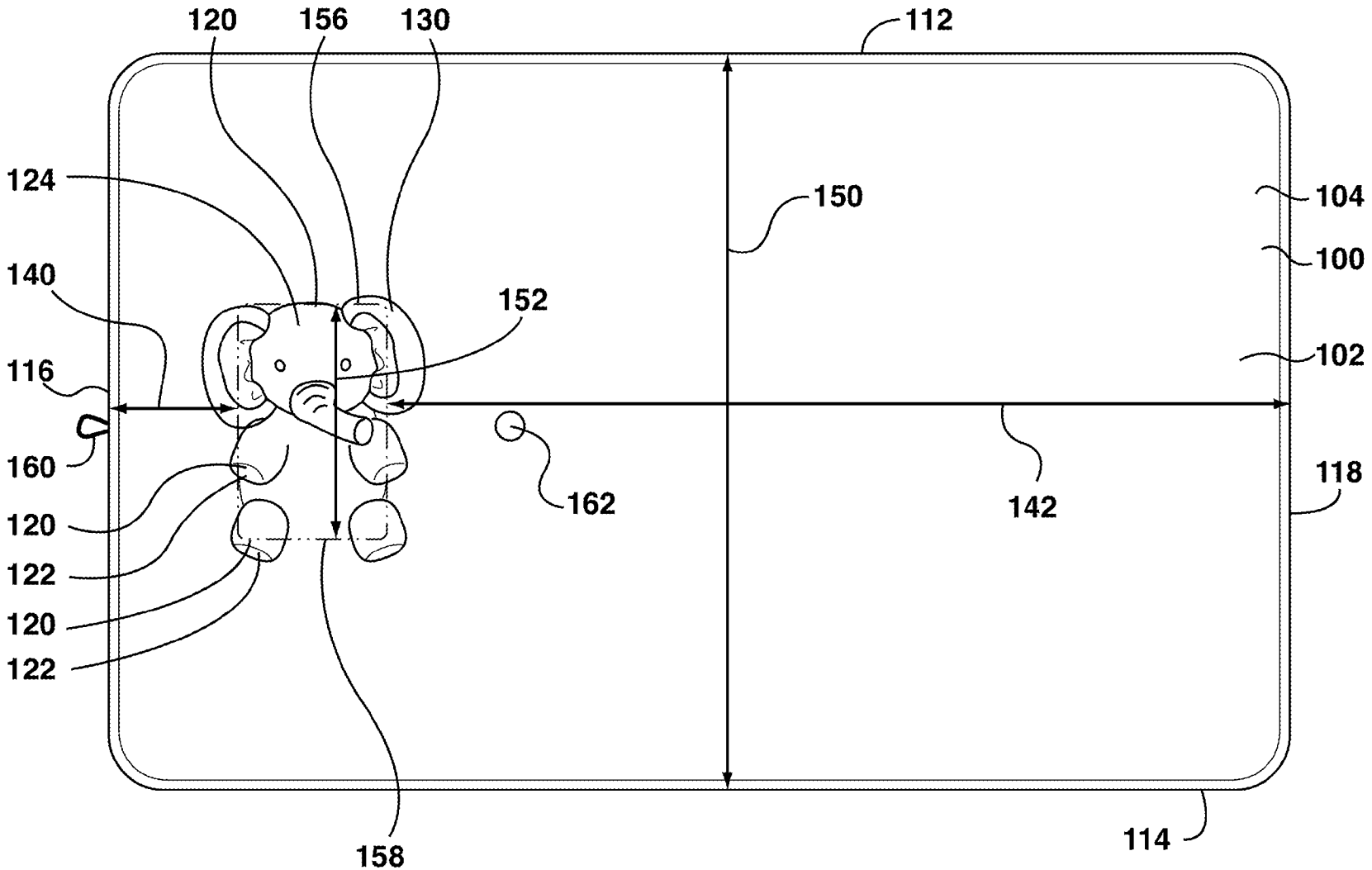
FIG. 1 is a top view of a convertible blanket when converted for use as a blanket in accordance with example embodiments of the present disclosure.

In one example embodiment, the present application describes a convertible blanket that converts between a blanket and a toy resembling a creature. The convertible blanket includes a fabric blanket portion having a top end, a bottom end and sides extending between the top end and the bottom end. The convertible blanket also includes one or more front-of-creature features defining a front of the creature. The front-of-creature features are disposed on a surface of the fabric blanket portion to offset the front of the creature from each of the sides of the fabric blanket portion. The convertible blanket also includes one or more fasteners attached to the fabric blanket portion. The one or more fasteners are configured to releasably hold the convertible blanket in a position where the toy is formed by rolling the fabric blanket portion from the side of the fabric blanket portion furthest from the front of the creature to the side of the fabric blanket portion nearest the front of the creature.

In another example embodiment, the present application describes a method of converting a convertible blanket from a blanket to a toy resembling a creature. The convertible blanket includes a fabric blanket portion having a top end, a bottom end and sides extending between the top end and the bottom end. The convertible blanket further includes one or more front-of-creature features defining a front of the creature. The front-of-creature features are disposed offset the front of the creature from the top end of the fabric blanket portion. The convertible blanket further includes one or more fasteners attached to the fabric blanket portion. The method includes: folding a region of the fabric blanket portion between the front of the creature and the top end behind a region of the fabric blanket associated with the front of the creature; after folding, rolling the fabric blanket portion from the side of the fabric blanket portion furthest from the front of the creature to the side of the fabric blanket portion nearest the front of the creature; and fastening the fastener to hold the fabric blanket portion in a rolled and folded position.

In yet another example embodiment, the present application describes a kit. The kit includes a convertible blanket. The convertible blanket includes a fabric blanket portion having a top end, a bottom end and sides extending between the top end and the bottom end. The convertible blanket also includes one or more front-of-creature features defining a front of the creature. The front-of-creature features are disposed to offset the front of the creature from the top end of the fabric blanket portion. The convertible blanket also includes one or more fasteners attached to the fabric blanket portion. The kit further includes instructions for converting the convertible blanket to a creature. In at least some embodiments, the instructions may be instructions to: fold a region of the fabric blanket portion between the front of the creature and the top end behind a region of the fabric blanket associated with the front of the creature; after folding, roll the fabric blanket portion from the side of the fabric blanket portion furthest from the front of the creature to the side of the fabric blanket portion nearest the front of the creature; and fasten the fastener to hold the fabric blanket portion in a rolled and folded position.

Figure 2:
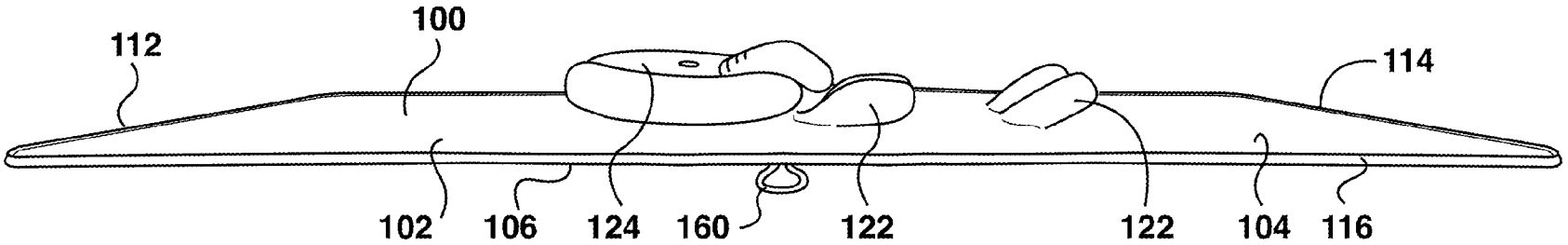
FIG. 2 is a side perspective view of the convertible blanket of FIG. 1.

Reference will be made to FIGS. 1 and 2 which illustrate a convertible blanket 100 in an extended position, in which the convertible blanket 100 may be used as a cover. More particularly, FIG. 1 illustrates a top view of the convertible blanket 100 and FIG. 2 illustrates a side view of the convertible blanket 100 looking into a first side 116 of the convertible blanket 100.

The convertible blanket of FIG. 1 is illustrated in an extended position, in which the convertible blanket 100 may be used as a cover. In the example of FIG. 1, in the extended position, the convertible blanket 100 may be a bed covering or other covering for warmth. In other example embodiment, the convertible blanket 100 may have other uses when in the extended position. For example, in some embodiments, the convertible blanket may be a towel when in the extended position.

As will be described in greater detail below, the convertible blanket may be converted to a toy 800 (FIGS. 8 and 9) resembling a creature. The toy 800 may, for example, resemble a stuffed animal. More particularly, the toy may resemble a creature such as an animal (e.g. a dog, elephant, rabbit, giraffe, monkey, etc.) or a person (e.g. it may act as a doll) or a fictional creature, such as a mythical creature or alien. The creature may, in at least some example embodiments, be a television character such as a cartoon character.

Figure 8:
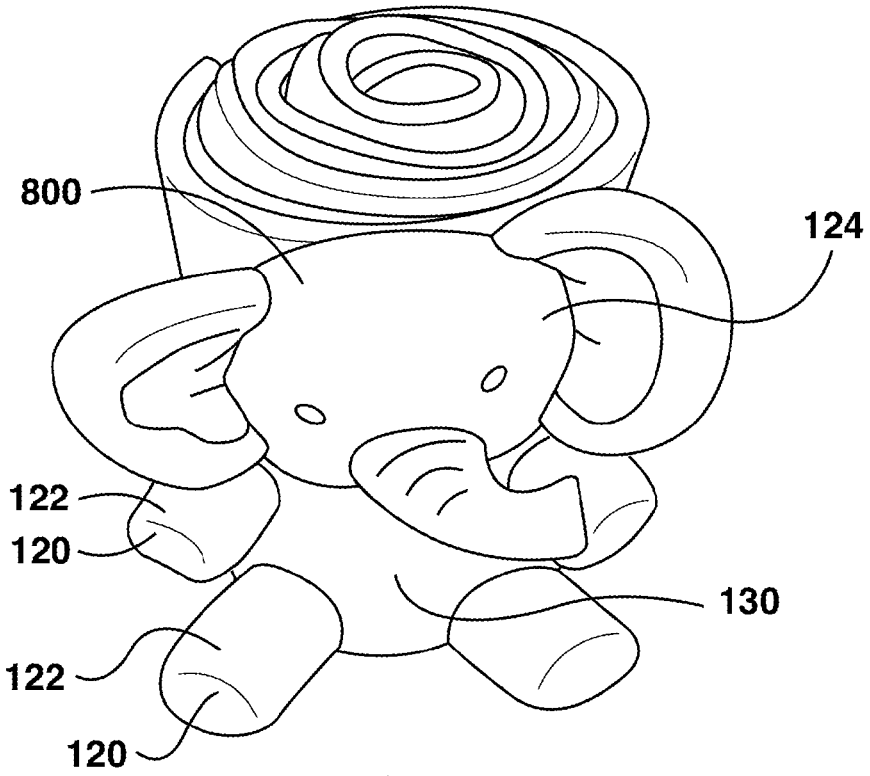
FIG. 8 is a front perspective view of the convertible blanket of FIG. 1 when converted to a toy.
Figure 9:
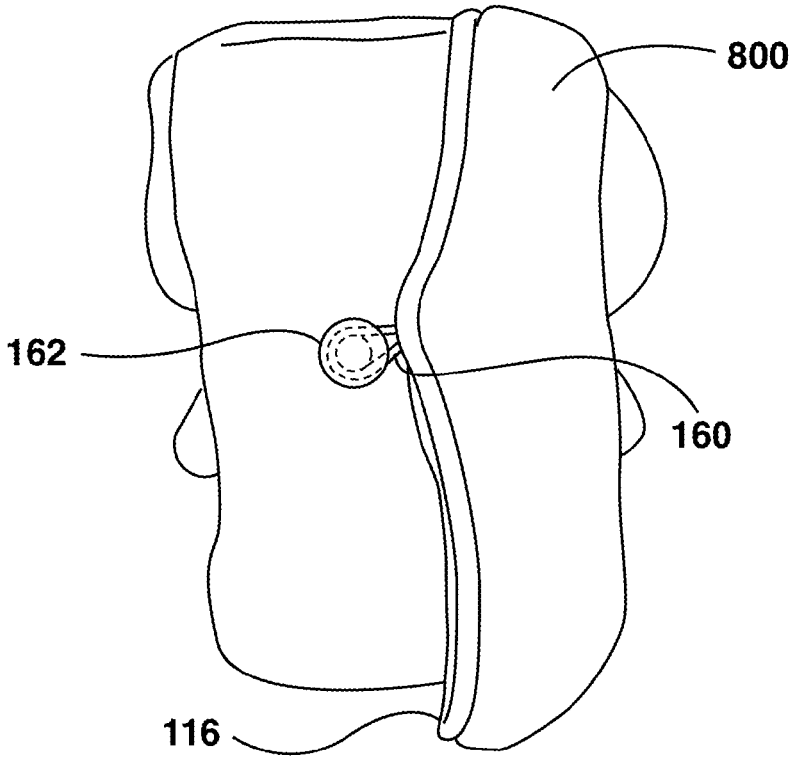
FIG. 9 is a rear view of the convertible blanket of FIG. 1 when converted to a toy.

An example of the toy 800 is illustrated in FIGS. 8 and 9 and will be discussed in greater detail below.

In the example embodiment of FIG. 1, the convertible blanket includes a fabric blanket portion 102. The fabric blanket portion 102 may be a cloth such as, for example, a cotton or wool cloth. The convertible blanket 100 is, in at least some embodiments, hypo-allergenic. In such embodiments, the fabric blanket portion 102 may be constructed of a hypoallergenic material.

The fabric blanket portion 102 has two surfaces—a top surface 104 and a bottom surface 106 (FIG. 2). The bottom surface 106 and the top surface 104 are generally parallel surfaces. While the bottom surface 106 is not illustrated in FIG. 1, it may be directly beneath the top surface 104 illustrated in FIG. 1.

In at least some embodiments, the fabric blanket portion 102 may be constructed of materials that have one or more soft surfaces 104, 106. For example, in at least some embodiments, the fabric blanket portion 102 is constructed of a material which has at least one fuzzy surface. Accordingly, in at least some embodiments, the top surface 104 may be soft and fuzzy.

The fabric blanket portion 102 has a top end 112 and a bottom end 114 and sides 116, 118 extending between the top end 112 and the bottom end 114. That is, each of the sides 116, 118 may connect to both the top end 112 and the bottom end 114.

In the example embodiment illustrated, the fabric blanket portion 102 is substantially rectangular. That is, the top end 112, bottom end 114 and sides 116, 118 collectively form a rectangle. In such an embodiment, the top end 112 and the bottom end 114 are parallel to one another and a first side 116 is parallel to a second side 118.

In the example embodiment illustrated, the ends 112, 114 do not connect with the sides 116, 118 with a right angle. Rather, the fabric blanket portion 102 includes rounded corners. However, in other embodiments, square corners may be used (i.e. the ends 112, 114 and the sides 116, 118 may connect at right angles).

The sides 116, 118 may have a common length. Similarly, the ends 112, 114 may have a common length. In the embodiment illustrated, the ends are longer than the sides.

The convertible blanket 100 also includes one or more front-of-creature features 120. The front-of-creature features 120 may define a front of the creature. That is, the front-of-creature features 120 may collectively define the front of the creature 130. The front of the creature 130 may resemble a creature, as viewed from the front. For example, the front of the creature 130 may resemble a front of an animal, person or a fictional creature. The front of the creature 130 is the portion of the convertible blanket 100 which is viewable from a front side when the convertible blanket is converted to a toy 800 resembling the creature.

The front-of-creature features 120 may, in at least some embodiments, include one or more appendages 122 associated with the creature. The appendages 122 may, for example, include one or more arms. The appendages 122 may also include one or more legs. In the embodiment illustrated, the front-of-creature features 120 include two arms and two legs. An appendage 122 may be attached to the fabric blanket portion 102 and one end of the appendage 122 and may be freely movable at another end of the appendage 122. For example, the appendage 122 may be sewn, glued or stitched to the fabric blanket portion 102 at one end and another end may be movable so that a user may move the appendages up and down at one end; for example, to simulate walking. Example appendages which are affixed at one end and which are freely movable at another end are illustrated in FIG. 2.

The appendages 122 may, in at least some embodiments, be constructed of the same material as the fabric blanket portion 102. For example, exterior surfaces of the appendages 122 may have a similar look and feel as the top surface 104 of the fabric blanket portion 102. In some embodiments, the appendages 122 may be stuffed. That is, a filling (which may be referred to as a stuffing) may be included in the appendages 122 to give the appendages a more voluminous look and feel. In other embodiments, the appendages 122 may not be filled. Embodiments which do not include filling in the appendages may allow the appendages to rest more closely against fabric blanket portion. That is, the appendages 122 may be softer and may protrude from the fabric blanket portion 102 to a lesser extent than when filling is used, thereby creating a convertible blanket 100 which is more blanket-like.

The front-of-creature features 120 may also include a head 124 of the creature. The head 124 may, for example, resemble an animal head, human head or a head associated with a fictitious creature. Accordingly, the head 124 may include one or more facial features such as ears, eyes, a nose, a mouth, and/or a trunk. In at least some embodiments, the head 124 may be attached to the fabric blanket portion 102 by stitching or sewing the head 124 to the fabric blanket portion 102. In some embodiments, an adhesive may be used to attach the head 124 to the fabric blanket portion 102. In at least some such embodiments, the head 124 may constructed, in whole or in part, using the same material used to construct the fabric blanket portion 102. In at least some embodiments, the head 124 may be stuffed. That is, a filling may be included in the head 124 to give the head a more voluminous look and feel.

The head 124 may include one or more appendages, such as a trunk or ears which are attached to the convertible blanket 100 at one end (e.g. by attaching an end of such appendages to the fabric blanket portion 102) and freely movable at another end of the appendage. This allows such appendages to be moved relative to the head 124. For example, ears may be wiggled and a trunk of a creature such as an elephant may be moved.

In at least some embodiments, one or more of the front-of-creature features 120 may be formed by applying a dye or print to the fabric blanket portion 102. For example, an image representing a front of a creature may be printed onto the fabric blanket portion 102 using a suitable printing technique.

Accordingly, the front-of-creature features 120 may collectively define a front of the creature 130. The front of the creature 130 is illustrated in FIG. 1 using broken lines. These broken lines are not intended to illustrate hidden features and are used merely to illustrate the front of the creature 130, which is a specific region of the convertible blanket 100. The front of the creature 130 may generally be rectangular in shape (though it may have some features which protrude outside of the rectangle, such as the ears illustrated in FIG. 1).

In the example embodiment illustrated, the front-of-creature features 120 are positioned to appear to be aligned with features of the fabric blanket portion 102. That is, legs are connected to the fabric blanket portion 102 so that the legs are both approximately the same distance from the bottom end 114 of the fabric blanket portion 102. The legs may be collectively generally parallel to the bottom end 114 and the top end 112. For example, the legs are mounted so that a line running through a common point on each of the legs is parallel to the bottom end 114 and the top end 112.

Similarly, each of the arms is positioned at approximately the same distance from the bottom end 114 as the other of the arms. The arms may be collectively generally parallel to the bottom end 114 and the top end 112. That is, the arms are mounted so that a line running through a common point on each of the arms is parallel to the bottom end 114 and the top end 112.

The head 124 is positioned to be above the arms (i.e. closer to the top end 112 than the arms). The head 124 is generally positioned centrally above the arms.

Accordingly, the front-of-creature features may be positioned so that the creature appears to be standing or sitting on a line which is parallel to the top end 112 and/or the bottom end 114.

The front-of-creature features 120 are disposed on the top surface 104 of the fabric blanket portion 102 near one side 116, 118 of the fabric blanket portion 102. The front-of-creature features 120 are placed at a distance from the sides 116, 118 of the fabric blanket portion 102 to offset the front of the creature 130 from each of the sides 116, 118. That is, a first offset 140 exists between the front of the creature 130 and a first side 116 (which is the left side in the example illustrated) and a second offset 142 exists between the front of the creature 130 and a second side 118 of the fabric blanket portion 102 (which is the right side in the example illustrated).

These offsets 140, 142 serve different purposes. The second offset 142, is the larger of the two offsets 140, 142. The second offset 142 has the larger offset to allow a toy resembling the creature to be formed by rolling the fabric blanket portion from the second side 118 (which is the side furthest from the front of the creature 130) towards the first side 116 (which is the side closest to the front of the creature 130). That is the fabric blanket portion may be rolled along the bottom surface 106 of the fabric blanket portion 102 to form the toy.

The first offset 140 ensures that the first side 116 of the fabric blanket portion 102 is away from the front of the creature 130 when the convertible blanket 100 is converted into the toy 800. That is, as will be understood from a review of FIG. 9, when the convertible blanket is converted to the toy, a side 116 of the fabric blanket portion 102 may be exposed. The first offset 140 ensures that the point of exposure will be away from the front of the creature 130. This ensures that the toy 800 appears more realistic when viewed from the front and may help to prevent the toy from being inadvertently converted to the blanket (i.e. to the extended position of FIGS. 1 and 2) when it is being used as a toy 800. Also, the first offset 140 assists the fasteners 160, 162, which will be discussed below.

The amount of the first offset 140 may depend on the thickness of the fabric blanket portion 102 and the size of the fabric blanket portion 102. In at least some embodiments, the first offset 140 is greater than one inch. In at least some embodiments, the first offset 140 is greater than two inches.

In order to prevent the region of the fabric blanket portion 102 between the front of the creature 130 and the first side 116 from covering the front of the creature 130 when the convertible blanket is converted to the toy 800, the first offset 140 may be a relatively small offset. The amount of offset which would cause the first side 116 to interfere with the front of the creature 130 when the convertible blanket is converted to the toy 800 will depend on the thickness of the fabric blanket portion 102 and the size of the fabric blanket portion 102. In at least some embodiments, the first offset 140 is an amount which causes the first side 116 to be located at or near the rear of the creature when the convertible blanket 100 is converted to the toy. For example, the side 116 may be located adjacent to a tail of the creature when the convertible blanket 100 is converted to a toy 800. In at least some embodiments, the first offset 140 is less than six inches. In some embodiments, the first offset 140 is in the range of two to six inches. The first offset 140 may, in some embodiments, be defined based on the circumference of the convertible blanket 100 when converted to the toy 800; for example, in at least some embodiments, the first offset 140 may be in the range of one-sixth to one-half of the circumference.

In at least some embodiments, a creature height 152 of the front of the creature 130 may be less than a blanket height 150 of the fabric blanket portion 102. The blanket height 150 of the fabric blanket portion 102 is defined by the top end 112 and the bottom end 114 of the fabric blanket portion 102. More particularly, the distance between the top end 112 and the bottom end 114 is the height of the fabric blanket portion 102. The creature height 152 of the front of the creature 130 may be defined by the distance between a top end 156 and the bottom end 158 of the front of the creature 130. The creature height 152 may represent the height of the toy 800.

The front-of-creature features 120 may be disposed on the fabric blanket portion 102 at a distance from the top end 112 of the fabric blanket portion 102 to offset the front of the creature 130 from the top end 112 of the fabric blanket portion 102. Similarly, in some embodiments, the front-of-creature features 120 may be disposed on the fabric blanket portion 102 at a distance from the bottom end 114 of the fabric blanket portion 102 to offset the front of the creature 130 from the bottom end 114 of the fabric blanket portion 102. Accordingly, the front of the creature 130 may be offset from the top end 112 of the fabric blanket portion 102 and/or from the bottom end 114 of the fabric blanket portion 102. As will be understood from the discussions of FIGS. 3 to 9 below, which describe the conversion of the convertible blanket 100 to a toy 800, this arrangement creates one or more foldable regions of the fabric blanket portion above and/or below the front of the creature 130 (i.e. between the front of the creature 130 and the top end 112 of the fabric blanket portion 102 and/or between the front of the creature 130 and the bottom end 114 of the fabric blanket portion 102). As will be explained in greater detail below, these foldable regions of the fabric blanket portion 102 may be folded beneath other regions of the fabric blanket portion 102 when converting the convertible blanket to the toy. This method of conversion may create a toy 800 with more appropriate sizes than without such folding. That is, without such folding, a long, narrow toy would be created; however, the folding allows the toy to be wider (i.e. have a larger circumference) and to be shorter. Such folding allows the blanket to act as a typical blanket and also allows the toy 800 to be sized as a common stuffed animal so that it is both portable and easy to hold.

In at least some embodiments, in order to allow the front of the creature 130 to act as a guide when converting the convertible blanket to a toy, the creature height 152 of the front of the creature 130 may be a fraction of the blanket height 150. For example, in some embodiments, the creature height 152 may be approximately one half of the blanket height 150. In at least some such embodiments, the front of the creature 130 may be positioned immediately adjacent to one of the ends 112, 114 of the fabric blanket portion 102 so that only a single fold of the fabric blanket portion 102 is required to complete the conversion. In such embodiments, the blanket may be folded in half and then rolled to convert to the toy 800. For example, the convertible blanket may be converted to the toy by folding a region of the fabric blanket portion between the front of the creature 130 and the top end 112, behind a region of the fabric blanket portion 102 associated with the front of the creature 130, and by then rolling the fabric blanket portion 102 from the side 118 of the fabric blanket portion 102 furthest from the front of the creature 130 to the side 116 of the fabric blanket portion 102 nearest the front of the creature 130.

In other embodiments, the creature height 152 may be approximately one third of the blanket height 150. In at least some such embodiments, the front of the creature 130 may be positioned midway between the top end 112 and the bottom end 114. In such embodiments, the convertible blanket 100 is converted to the toy 800 by folding a region of the fabric blanket portion between the front of the creature 130 and the top end 112 of the fabric blanket portion 102 behind a region of the fabric blanket portion 102 associated with the front of the creature 130, and by folding a region of the fabric blanket portion 102 between the front of the creature 130 and the bottom end 114 of the fabric blanket portion 102 behind the region of the fabric blanket portion 102 associated with the front of the creature 130 and by then rolling the fabric blanket portion 102 from the side 118 of the fabric blanket portion 102 furthest from the front of the creature 130 to the side 116 of the fabric blanket portion 102 nearest the front of the creature.

The convertible blanket 100 also includes one or more fasteners 160, 162 attached to the fabric blanket portion 102. The fasteners 160, 162 are configured to releasably hold the convertible blanket 100 in a position where the toy 800 is formed by rolling the fabric blanket portion 102 from the side 118 of the fabric blanket portion 102 furthest from the front of the creature 130 to the side 118 of the fabric blanket portion 102 nearest the front of the creature 130 (and possibly by folding the fabric blanket portion 102 prior to such rolling).

In the embodiment illustrated, the fasteners include a first fastener 160 attached to the fabric blanket portion 102 between one of the sides 116, 118 of the fabric blanket portion 102 and a side of the front of the creature 130. In the embodiment illustrated, the first fastener 160 is attached to the fabric blanket portion at a position which is near (e.g. within one inch) the side 116 of the fabric blanket portion 102 that is closest to the front of the creature 130. In the embodiment illustrated, the first fastener 160 is a loop connector which is formed using an elongate elastic having ends attached to the fabric blanket portion 102. The loop connector is attached to the bottom surface 106 of the fabric blanket portion 102 (i.e. the surface not having the front-of-creature features 120).

The fasteners 160, 162 also include a second fastener 162 attached to the fabric blanket portion 102 between the other of the sides 116, 118 of the fabric blanket portion (i.e. the side 116, 118 of the fabric blanket portion which is opposite the side nearest the first fastener 160) and the other of the sides of the front of the creature 130 (i.e. the side of the front of the creature 130 which is opposite the side nearest the first fastener 160). The second fastener 162 is configured to engage the first fastener 160 when the convertible blanket 100 is converted to the toy 800 resembling the creature by rolling the fabric blanket portion 102 along its bottom surface 106 from the side 118 of the fabric blanket portion 102 further from the front of the creature 130 to the side 116 of the fabric blanket portion 102 nearest the front of the creature 130.

In the embodiment illustrated, the second fastener 162 forms a tail of the creature. That is, the second fastener 162 is configured to resemble a tail and is positioned so that it is located at the rear of the creature when the convertible blanket is converted to the toy 800 resembling the creature. In the embodiment illustrated, the second fastener 162 is constructed of a ball that is attached to the surface of the fabric blanket portion 102. The ball may be covered with fabric, which may be the same fabric used for the fabric blanket portion. In at least some embodiments, the loop connector which forms the first fastener 160 may have an at-rest circumference that is smaller than the circumference of the ball at its widest cross section. In such embodiments, the loop connector may be elastic and/or the ball may be compressible so that the loop connector is able to fit around the ball when external force is applied to the loop connector or the ball, but does not easily slip off of the ball.

While the illustrated embodiment illustrates a ball which acts as a second fastener 162 which connects to a loop connector which acts as a first fastener 160, in other embodiments, the first fastener 160 may be constructed of a ball and/or may resemble a tail of the creature and the second fastener 162 may be a loop connector.

The fasteners 160, 162 may be separated by a distance which corresponds to a circumference of the creature when the convertible blanket is converted to the toy.

Example methods of converting the convertible blanket 100 to the toy 800 resembling the creature will now be discussed with reference to FIGS. 3 to 9.

Figure 3:
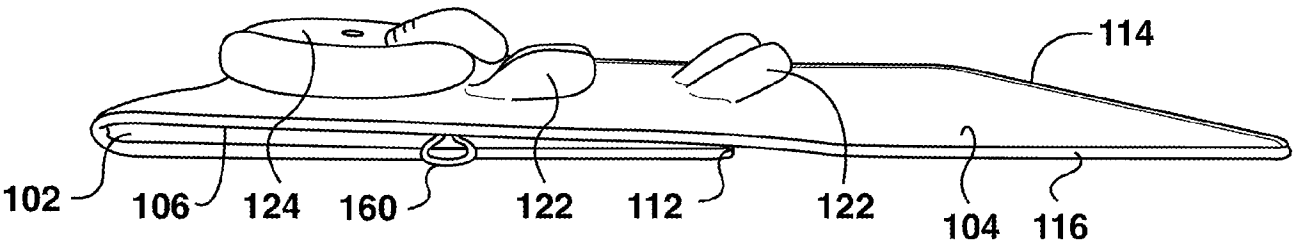
FIG. 3 is a side perspective view of the convertible blanket of FIG. 1 when a portion of the convertible blanket has been folded to begin converting the convertible blanket to a toy.
Figure 4:
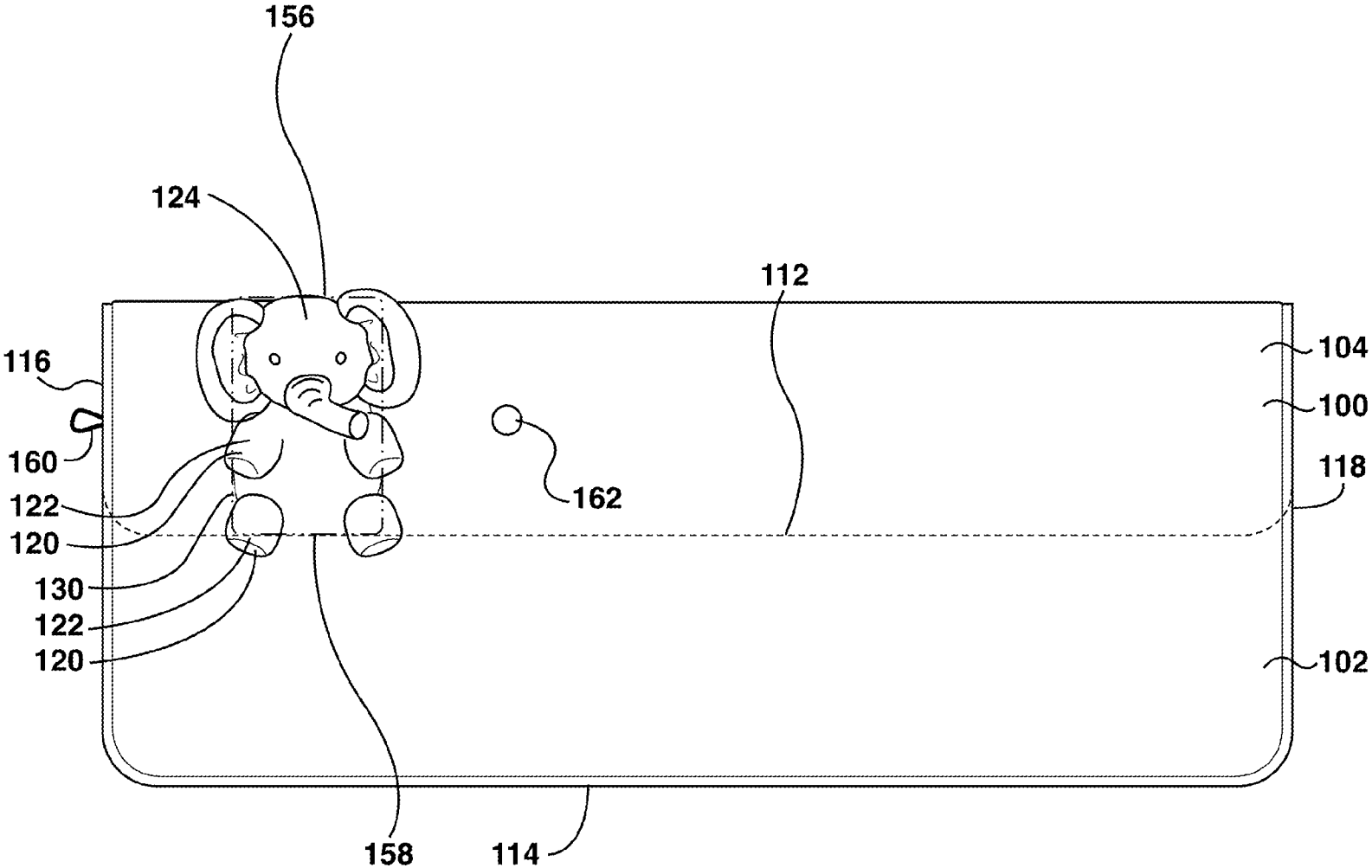
FIG. 4 is a top view of the convertible blanket of FIG. 1 when folded in the manner illustrated in FIG. 3.

Referring first to FIGS. 3 and 4, a region of the fabric blanket portion between the front of the creature 130 and the top end 112 of the front of the creature 130 may be folded behind a region of the fabric blanket portion 102 associated with the front of the creature 130. FIG. 3 illustrates a side perspective view of the convertible blanket and FIG. 4 illustrates a top view.

In the example illustrated, approximately one third of the fabric blanket portion 102 is folded. The fabric blanket portion 102 is folded along a line which is generally parallel to the bottom end 114 of the fabric blanket portion 102. The line runs along a portion of the front-of-creature features 120 which is nearest the top end 112 of the fabric blanket portion 102. In the example illustrated, the fold is along the top end 156 (FIG. 4) of the front of the creature 130. Thus, the front-of-creature features 120 act as a guide for the fold.

Figure 5:
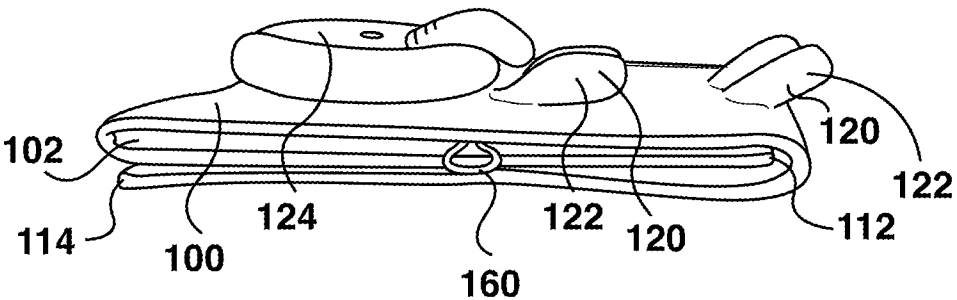
FIG. 5 is a side perspective view of the convertible blanket of FIG. 1 when a further portion of the convertible blanket has been folded to continue converting the convertible blanket to the toy.
Figure 6:
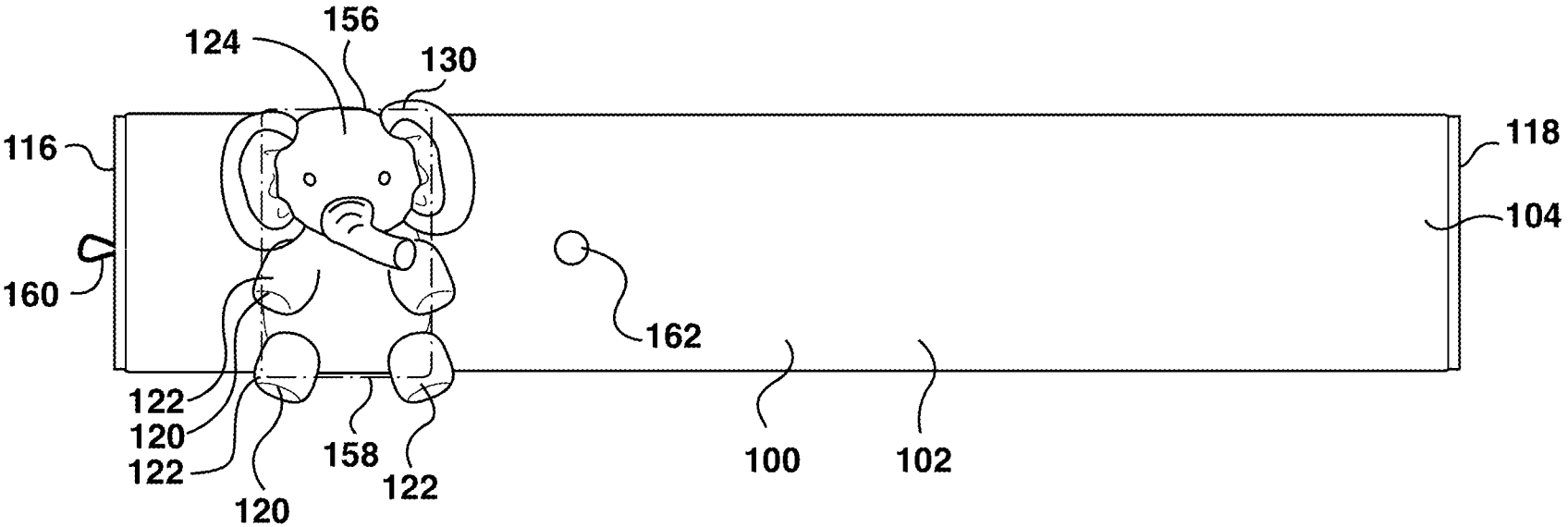
FIG. 6 is a top view of the convertible blanket of FIG. 1 when folded in the manner illustrated in FIG. 5.

As illustrated in FIGS. 5 and 6, a region of the fabric blanket portion 102 between the front of the creature 130 and the bottom end 114 of the fabric blanket portion 102 may be folded behind the region of the fabric blanket portion 102 associated with the front of the creature 130. FIG. 5 illustrates a side perspective view of the convertible blanket 100 and FIG. 6 illustrates a top view.

The line of the fold may be generally parallel to the line of the fold described with reference to FIGS. 3 and 4. In the example illustrated, the fold is along the bottom end 158 (FIG. 6) of the front of the creature 130. Thus, the front-of-creature features 120 act as a guide for the fold.

Figure 7:
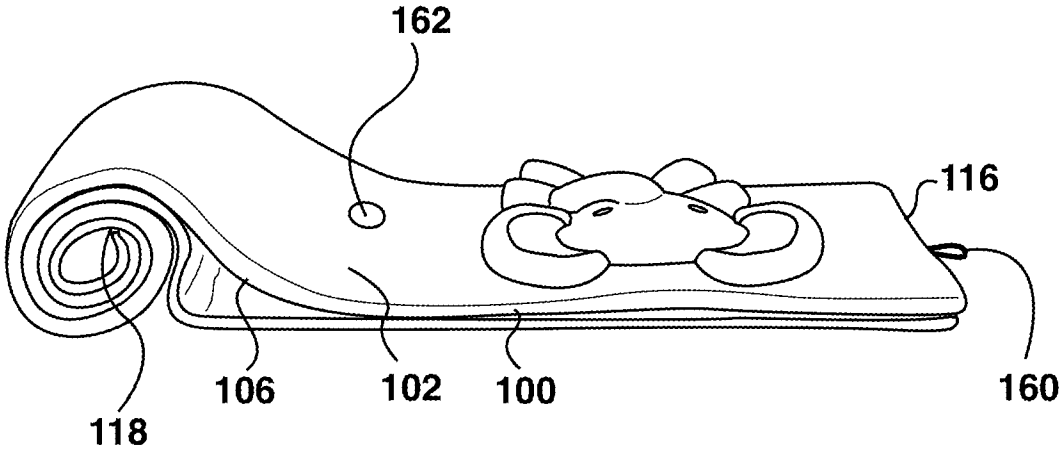
FIG. 7 is a top end perspective view of the convertible blanket of FIG. 1 when the convertible blanket is partially rolled to continue converting the convertible blanket to the toy.

Referring now to FIG. 7, after folding, the convertible blanket 100 may be further converted by rolling the fabric blanket portion 102 from the side 118 of the fabric blanket portion furthest from the front of the creature 130 to the side 116 of the fabric blanket portion 102 nearest the front of the creature 130. The rolling is performed along the bottom surface 106 of the fabric blanket portion 102 so that the front of the creature 130 remains exposed after the rolling. FIG. 7 illustrates a top end perspective view of the convertible blanket 100.

After the rolling, the fastener(s) 160, 162 may be fastened to hold the fabric blanket portion 102 in a rolled and folded position in which the convertible blanket 100 is converted to the toy 800 resembling the creature. FIG. 8 illustrates a front perspective view of the toy 800 and FIG. 9 illustrates a rear perspective view of the toy 800. In the example illustrated, the fasteners 160, 162 are fastened to one another by stretching the loop connector (which forms the first fastener 160) over the ball (which forms the second fastener 162).

In at least some example embodiments, a kit may be provided having a convertible blanket 100 according to one or more of the example embodiments described herein. The kit may also include instructions indicating a method of converting the convertible blanket 100 to a creature. The method may be one of the methods described herein.

Other example embodiments of the present disclosure will be apparent to those of ordinary skill in the art from a review of the following detailed description in conjunction with the drawings.

The various example embodiments presented above are merely examples. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A convertible blanket that converts between a blanket and a toy resembling a creature, the convertible blanket comprising:

a fabric blanket portion having a top end, a bottom end and sides extending between the top end and the bottom end;

one or more front-of-creature features defining a front of the creature, the front-of-creature features being disposed on a surface of the fabric blanket; and one or more fasteners attached to the fabric blanket portion, the one or more fasteners being configured to releasably hold the convertible blanket in a position where the toy is formed by rolling the fabric blanket portion from one of the sides of the fabric blanket portion to the other of the sides of the fabric blanket portion, wherein one or more of the fasteners form a tail of the creature and wherein the tail is an appendage, and wherein the fastener that forms the tail of the creature comprises a ball attached to the fabric blanket portion and another of the fasteners is a loop connector.

2. The convertible blanket of claim 1, wherein an offset between the front of the creature and the side of the fabric blanket portion nearest the front of the creature is greater than one inch.

3. The convertible blanket of claim 1, wherein the one or more fasteners comprise:

a first fastener attached to the fabric blanket portion between one of the sides of the fabric blanket portion and a side of the front of the creature; and a second fastener attached to the fabric blanket portion between the other of the sides of the fabric blanket portion and another side of the front of the creature, the second fastener being configured to engage the first fastener when the convertible blanket is converted to the toy resembling the creature by rolling the fabric blanket portion from one of the sides of the fabric blanket portion to the other of the sides of the fabric blanket portion.

4. The convertible blanket of claim 3, wherein the second fastener forms the tail of the creature.

5. The convertible blanket of claim 1, wherein the loop connector comprises an elongate elastic having ends attached to the fabric blanket portion.

6. The convertible blanket of claim 1, wherein the top end of the blanket and the bottom end of the blanket define a blanket height therebetween and wherein the front of the creature has a top end and a bottom end, the top end of the creature and the bottom end of the creature defining a creature height, the creature height being less than the blanket height.

7. The convertible blanket of claim 6 wherein the creature height is approximately one half of the blanket height.

8. The convertible blanket of claim 6, wherein the creature height is approximately one third of the blanket height.

9. The convertible blanket of claim 1 wherein the front-of-creature features are disposed on the fabric blanket portion to offset the front of the creature from the top end of the fabric blanket portion and wherein the second fastener is separated from the first fastener by a distance which corresponds to a circumference of the creature when the convertible blanket is converted to the toy by folding a region of the fabric blanket portion between the front of the creature and the top end behind a region of the fabric blanket associated with the front of the creature and by then rolling the fabric blanket portion from one of the sides of the fabric blanket portion to the other of the sides of the fabric blanket portion.

10. The convertible blanket of claim 1, wherein the front-of-creature features are disposed on the fabric blanket portion to offset the front of the creature from the top end of the fabric blanket portion, and wherein the front-of-creature features are disposed on the fabric blanket portion to offset the front of the creature from the bottom end of the fabric blanket portion, and wherein the second fastener is separated from the first fastener by a distance which corresponds to a circumference of the creature when the convertible blanket is converted to the toy by folding a region of the fabric blanket portion between the front of the creature and the top end behind a region of the fabric blanket associated with the front of the creature and by folding a region of the fabric blanket portion between the front of the creature and the bottom end behind the region of the fabric blanket associated with the front of the creature and by then rolling the fabric blanket portion from one of the sides of the fabric blanket portion to the other of the sides of the fabric blanket portion.

11. The convertible blanket of claim 1, wherein the front-of-creature features include one or more appendages attached to the fabric blanket portion at an end of the appendage and freely movable at another end of the appendage.

12. The convertible blanket of claim 11, wherein the appendages include one or more arms.

13. The convertible blanket of claim 11, wherein the appendages include one or more legs.

14. A method of converting a convertible blanket from a blanket to a toy resembling a creature, the convertible blanket comprising a fabric blanket portion having a top end, a bottom end and sides extending between the top end and the bottom end, the convertible blanket further comprising one or more front-of-creature features defining a front of the creature, the front-of-creature features being disposed on a surface of the fabric blanket portion, the convertible blanket further comprising one or more fasteners attached to the fabric blanket portion, one or more of the fasteners forming a tail of the creature, the tail being an appendage, wherein the fastener that forms the tail of the creature comprises a ball attached to the fabric blanket portion and another of the fasteners is a loop connector, the method comprising:

folding a region of the fabric blanket portion between the front of the creature and the top end behind a region of the fabric blanket associated with the front of the creature;

after folding, rolling the fabric blanket portion from one of the sides of the fabric blanket portion to the other of the sides of the fabric blanket portion; and fastening the fastener in a position corresponding to that of the tail of the creature to hold the fabric blanket portion in a rolled and folded position.

15. The method of claim 14, wherein the front-of-creature features are disposed on the fabric blanket portion to offset the front of the creature from the bottom end of the fabric blanket portion, the method further comprising, prior to rolling:

folding a region of the fabric blanket portion between the front of the creature and the bottom end behind the region of the fabric blanket associated with the front of the creature.

16. A kit comprising:

a convertible blanket comprising:

a fabric blanket portion having a top end, a bottom end and sides extending between the top end and the bottom end;

one or more front-of-creature features defining a front of the creature, the front-of-creature features being disposed on a surface of the fabric blanket portion; and one or more fasteners attached to the fabric blanket portion, one or more of the fasteners forming a tail of the creature, the tail being an appendage, wherein the fastener that forms the tail of the creature comprises a ball attached to the fabric blanket portion and another of the fasteners is a loop connector, and instructions indicating a method of converting the convertible blanket to a creature by:

folding a region of the fabric blanket portion between the front of the creature and the top end behind a region of the fabric blanket associated with the front of the creature;

after folding, rolling the fabric blanket portion from one of the sides of the fabric blanket portion to the other of the sides of the fabric blanket portion; and fastening the fastener in a position corresponding to that of the tail of the creature to hold the fabric blanket portion in a rolled and folded position.

17. The kit of claim 16 wherein the front-of-creature features are disposed on the fabric blanket portion to offset the front of the creature from the bottom end of the fabric blanket portion, and wherein the method of converting the convertible blanket to a creature further comprises, prior to rolling:

folding a region of the fabric blanket portion between the front of the creature and the bottom end behind the region of the fabric blanket associated with the front of the creature.

* * * * *